US009346615B2

(12) United States Patent
Bederke

(10) Patent No.: US 9,346,615 B2
(45) Date of Patent: May 24, 2016

(54) COUPLING MEMBER FOR INTERCONNECTING TWO CONTAINERS STACKED ONE ABOVE THE OTHER

(71) Applicant: SEC SHIPS EQUIPMENT CENTRE BREMEN GMBH & CO. KG, Bremen (DE)

(72) Inventor: Christian Bederke, Bremen (DE)

(73) Assignee: SEC SHIPS EQUIPMENT CENTRE BREMEN GMBH & CO. KG (DE)

( * ) Notice: Subject to any disclaimer, the term of this patent is extended or adjusted under 35 U.S.C. 154(b) by 0 days.

(21) Appl. No.: 14/389,775

(22) PCT Filed: Apr. 4, 2013

(86) PCT No.: PCT/DE2013/100122
§ 371 (c)(1),
(2) Date: Oct. 1, 2014

(87) PCT Pub. No.: WO2013/149617
PCT Pub. Date: Oct. 10, 2013

(65) Prior Publication Data

US 2015/0052708 A1 Feb. 26, 2015

(30) Foreign Application Priority Data

Apr. 5, 2012 (DE) ..... 20 2012 101 261 U

(51) Int. Cl.
*B65D 90/00* (2006.01)

(52) U.S. Cl.
CPC ..... *B65D 90/0006* (2013.01); *B65D 90/0013* (2013.01); *B65D 2590/0033* (2013.01); *Y10T 24/28* (2015.01)

(58) Field of Classification Search
CPC ..... B65D 90/0006; B65D 90/0013; B65D 2590/0033; Y10T 24/24
USPC ..... 24/287
See application file for complete search history.

(56) References Cited

U.S. PATENT DOCUMENTS

2005/0260054 A1 11/2005 Bederke
2009/0307877 A1* 12/2009 Boman et al. ..... 24/287
2009/0307977 A1 12/2009 Mangold et al.
2011/0036742 A1 2/2011 Fukui

FOREIGN PATENT DOCUMENTS

DE 202009013140 U1 12/2009
EP 2 233 408 A1 9/2010

OTHER PUBLICATIONS

International Search Report; PCT/DE2013/100122; International Filing Date: Apr. 4, 2013; 3 pgs.

* cited by examiner

*Primary Examiner* — Abigail Morrell
(74) *Attorney, Agent, or Firm* — Schmeiser, Olsen & Watts, LLP

(57) ABSTRACT

A coupling member for interconnecting two containers stacked one above the other, particularly on board ships, having a first coupling projection that can be hooked into a corner fitting of one container and pre-locked there, and a second coupling projection that can be coupled to a corner fitting of the other container, and having an actuating member by means of which the second coupling projection can be switched between an automatic position, in which the containers lock and unlock fully automatically during loading and unloading, and a second position, in which the containers must be manually unlocked by an operator during unloading, wherein the second coupling projection is moved under pre-tension into the automatic position or the second position and can be moved to the respective other position by means of the actuating member, counter to the pre-tensioning force is provided.

16 Claims, 20 Drawing Sheets

COUPLING MEMBER FOR INTERCONNECTING TWO CONTAINERS STACKED ONE ABOVE THE OTHER

CROSS-REFERENCE TO RELATED APPLICATIONS

This application claims priority to PCT Application No. PCT/DE2013/100122, having a filing date of Apr. 4, 2013, based off of DE 20 2012 101 261.8 having a filing date of Apr. 5, 2012, the entire contents of which are hereby incorporated by reference.

FIELD OF TECHNOLOGY

The following relates to a coupling member for interconnecting two containers stacked one above the other, in particular onboard ships, having a first coupling projection which can be hooked into a corner fitting of one container and be pre-locked there, and a second coupling projection which can be coupled to the other corner fitting and having an actuating member by means of which the second coupling projection can be switched between an automatic position in which the containers lock and unlock fully automatically during loading and unloading, and a second position in which the containers must be manually unlocked by an operator during unloading, wherein the second coupling projection is moved under pre-tension into the automatic position or the second position and can be moved to the other respective position by means of the actuating member counter to the pre-tensioning force.

BACKGROUND

A coupling member of this kind is described in DE 20 2009 013 140 U1.

Since the applicant of this utility model commercialized so-called fully automatic coupling members which are based on DE 102 38 895 A1, the fully automatic coupling members enjoy increasing popularity in the market place. The particular advantage of fully automatic coupling members lies in the fact that, when loading a container, for example, on a seabound ship, they automatically lock and again in contrast to semiautomatic designs, automatically unlock during unloading of the container. Thus, even when unloading the container, no manual unlocking of the coupling member by stowage personal is required any longer. Accordingly these fully automatic coupling members are able to securely connect two containers stacked above each other during a voyage.

Furthermore empty containers are often loaded and unloaded above each other in "tandem" which is also called "vertical tandem lift (VTL)". Two containers stacked above each other, which are connected to each other with coupling members, are thereby simultaneously loaded or unloaded by raising the upper container. This is naturally not possible with fully automatic coupling members.

There is thus a need for coupling members which can be used both semi-automatically as well as automatically and, when needed, can be switched between the two methods of functioning. The term 'semiautomatic' is understood to mean that the coupling members lock independently (automatically) during loading of the container; during debarkation (unloading), on the other hand however, must be manually unlocked by stowage personal. Then whenever no loading or unloading in "tandem lift" is desired or a comparatively quiet sea journey is expected, these coupling members should be used in the fully automatic function. If, however, a loading and unloading in "tandem lift" is desired or rough seas are expected during the transit, these coupling members should be used in the semiautomatic function.

Coupling members are described in EP 2 007 656 B1 or EP 2 233 408 A1 which can switch between a fully automatic function and a fully manual function. These coupling members are usually in the full automatic mode when loading and unloading containers. If the upper container is displaced from the lower container, the coupling members can be switched to the second position completely manually, in which position no fully automatic unlocking is possible anymore. Now two empty containers stacked above each other can be loaded or unloaded in a tandem lift. In addition, after loading of the containers the coupling members can be brought in this manner into a so-called safe position. For that reason the coupling members must be manually switched by stowage personnel both when loading and unloading. These coupling members thus can only be switched between a fully manual position and a fully automatic position and therefore cannot meet the previously stated requirements.

The coupling member according to DE 20 2009 013 140 U1 named at the outset should satisfy the above stated requirements, thus should namely be switchable between a semiautomatic position and a fully automatic position. To that end the coupling member has a blocking element which in the semiautomatic position prevents the lower coupling projection from sliding out of the upper long hole in the corner fitting of the lower container. This blocking member must also be manually unlocked, so that the upper container can be loosened from the lower container.

The blocking member of the coupling member is pre-tensioned in the direction toward the automatic position and can be switched by means of a Bowden cable into a second position in which the coupling member is supposed to act as a semiautomatic coupling member, namely to facilitate an automatic locking with the container, but can only be manually unlocked. Upon a closer inspection of the document it turns out, however, that this coupling member too can only be switched between an automatic position and a completely manual position, since the blocking member is positively secured in the second position against displacement in the direction toward the automatic position.

SUMMARY

Proceeding from this background, the basic problem is to further improve a coupling member of the type named at the outset, so that it can be used in both full automatic operation as well as semiautomatic operation, namely it is switchable between an automatic position and a semiautomatic position.

To solve this problem the inventive coupling member is characterized in that the second position of the second coupling projection is a semiautomatic position in which the containers lock fully automatically during loading, and in that the second coupling projection can be locked by locking the actuating member in the respective other position and can be moved counter to a second pre-tensioning force in the direction toward the automatic position or the semiautomatic position.

Just as in the coupling member according to DE 20 2009 013 140 U1, the inventive coupling member in a basic position is located in the automatic position in which it operates as a fully automatic coupling member. Alternatively, it is however possible that the base position corresponds to the semiautomatic position and the coupling member is switched into the automatic position by the actuating member. By means of the actuating mechanism the stowage personnel can switch the lower coupling projection into the respective other position, namely preferably into the semiautomatic position. In this position the actuating member can be locked. The lower coupling projection can be moved out of the second position counter to a second pre-tension force in the direction of the respective other position. If now an upper container is displaced on a lower container, the second coupling projection moves counter to the second pre-tension force because of the downward movement of the upper container in the direction to the other position (preferably the automatic position). As soon as the second coupling projection is immersed entirely in the long hole of the associated corner fitting, the second coupling projection automatically snaps again back into the second position because of the second pre-tensioning force. If the second position is the semiautomatic position, the second coupling projection is now so coupled with this corner fitting that it can now only be unlocked again manually by means of the actuating member. In the semiautomatic position the inventive coupling member functions like a conventional semiautomatic twist-lock. The inventive coupling member can thus be used both as a fully automatic coupling member as well as a semiautomatic coupling member.

It thereby does not matter in which orientation the coupling member is used, namely whether the first coupling projection is first locked in the upper corner fitting of the lower container, or in the lower corner fitting of the upper container. But because of the existing safety regulations, generally the first coupling projection is inserted into the lower corner fitting of the upper container and locked there. After all four lower corner fittings of the upper container are equipped with coupling members, this container is relocated to a container already stored onboard a ship. The first coupling projection is therefore also often designated as an upper coupling projection, while the second coupling projection is designated as the lower coupling projection. Now if a container of the lowest layer is stored, for example, directly on a hatch cover of a ship, which would also be possible with the inventive coupling members, in practice the coupling members would first be inserted quasi-overhead into the bases welded to the ship and then the containers of the lowest layer would be loaded on the ship.

According to an additional embodiment of the invention, the actuating member can be locked in the semiautomatic position to a locking means. This locking means is mounted so as to move and is pre-tensioned in the direction toward the semiautomatic position of the second coupling projection. This permits an especially simple manner of construction, since the actuating member is locked to a movable locking means pre-tensioned in the direction to the semiautomatic position. This happens by means of an especially simple design, when the locking means is mounted in a displaceable manner.

Furthermore, a simple manner of construction can also be achieved when the second coupling projection is mounted so as to rotate in a housing and can rotate between the automatic position and the semiautomatic position. The second coupling projection can hereby, when it is located in the semiautomatic position, automatically rotate in the direction of the automatic position relative to the housing and then snap back into the semiautomatic position, as soon as it is completely introduced into the associated corner fitting. It is especially favorable if the locking means is mounted on the housing.

BRIEF DESCRIPTION

Some of the embodiments will be described in detail, with reference to the following figures, wherein like designations denote like members, wherein.

DETAILED DESCRIPTION

Figure 1:
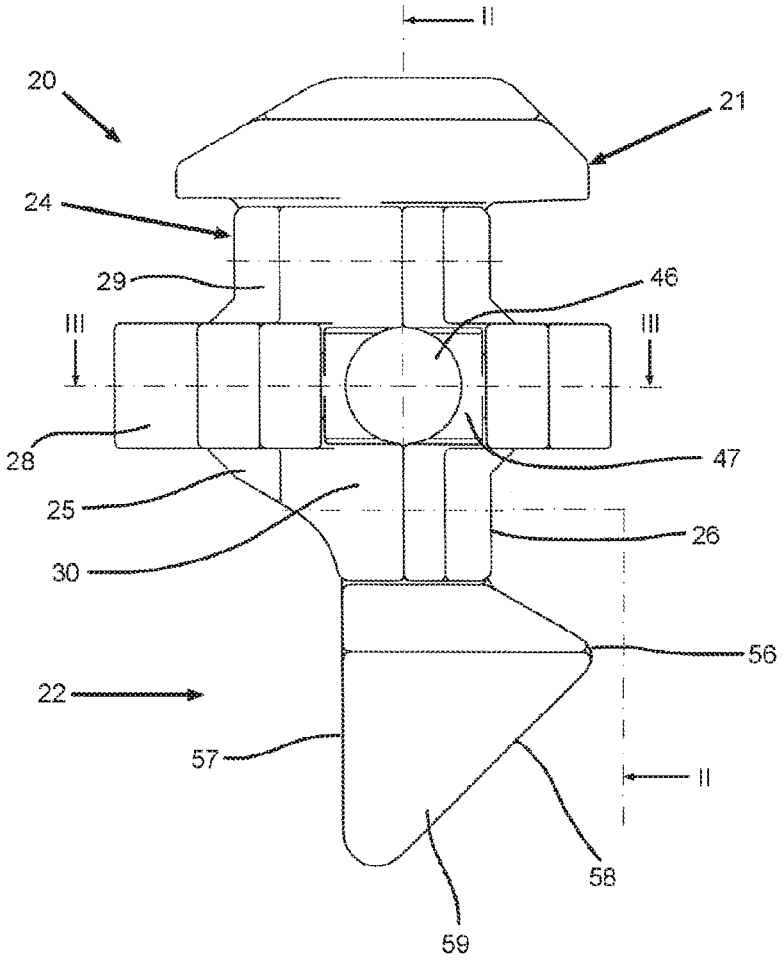
FIG. 1 is a front view in the automatic position of a coupling member with inventive characteristics.

The illustrated embodiment of an inventive coupling member 20 features a first, namely upper, coupling projection 21 and a second, namely lower, coupling projection 22. The upper coupling projection 21 and the lower coupling projection 22 are connected to each other with a common shaft 23. The coupling projections 21, 22 can thereby be connected to the shaft 23 in any suitable manner. In this case the coupling projections 21, 22 and the shaft 23 are constructed as one-piece with each other, namely as one-piece cast steel or forged parts.

The shaft 23 is rotatably mounted in a housing 24. The housing 24 is formed from two housing shells 25, 26 which are screwed to each other by means of screws 27. The housing shells 25, 26 are again constructed as one-piece cast steel or forged parts. Screwed to the housing 24 the housing shells 25, 26 together form a stop plate 28, an appendage 29 extending from the stop plate 28 upward to the upper coupling projection 21 and an appendage 30 extending from the stop plate 28 downward to the lower coupling projection 22. The contour of the upper appendage 29 thereby so corresponds to a long hole 31 of a lower corner fitting 32 of an upper container 33 (see FIG. 10) that the housing 24 cannot twist with respect to the lower corner fitting 32.

Figure 12:
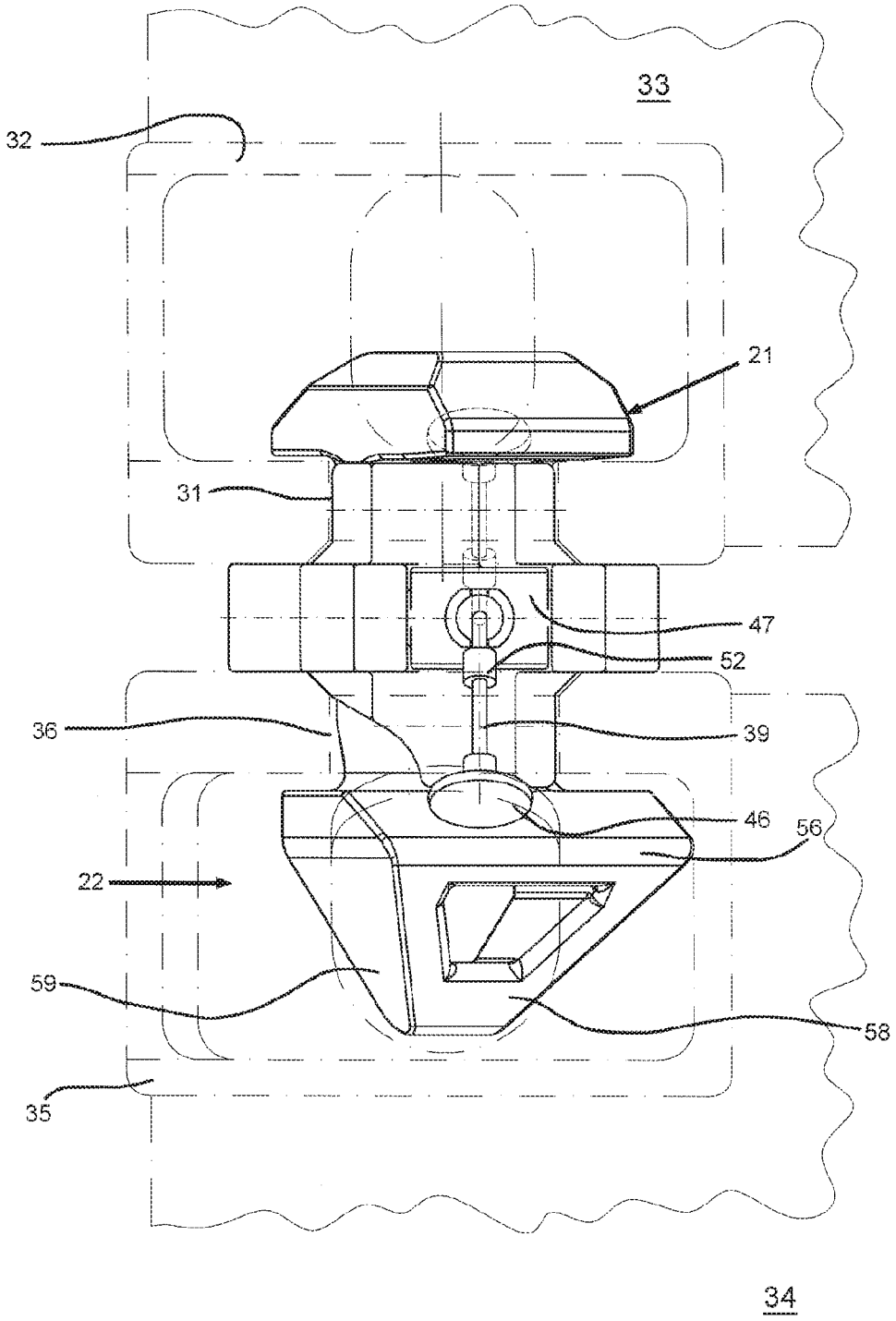
FIG. 12 is a coupling member according to FIG. 4 in a fully locked state.
Figure 13:
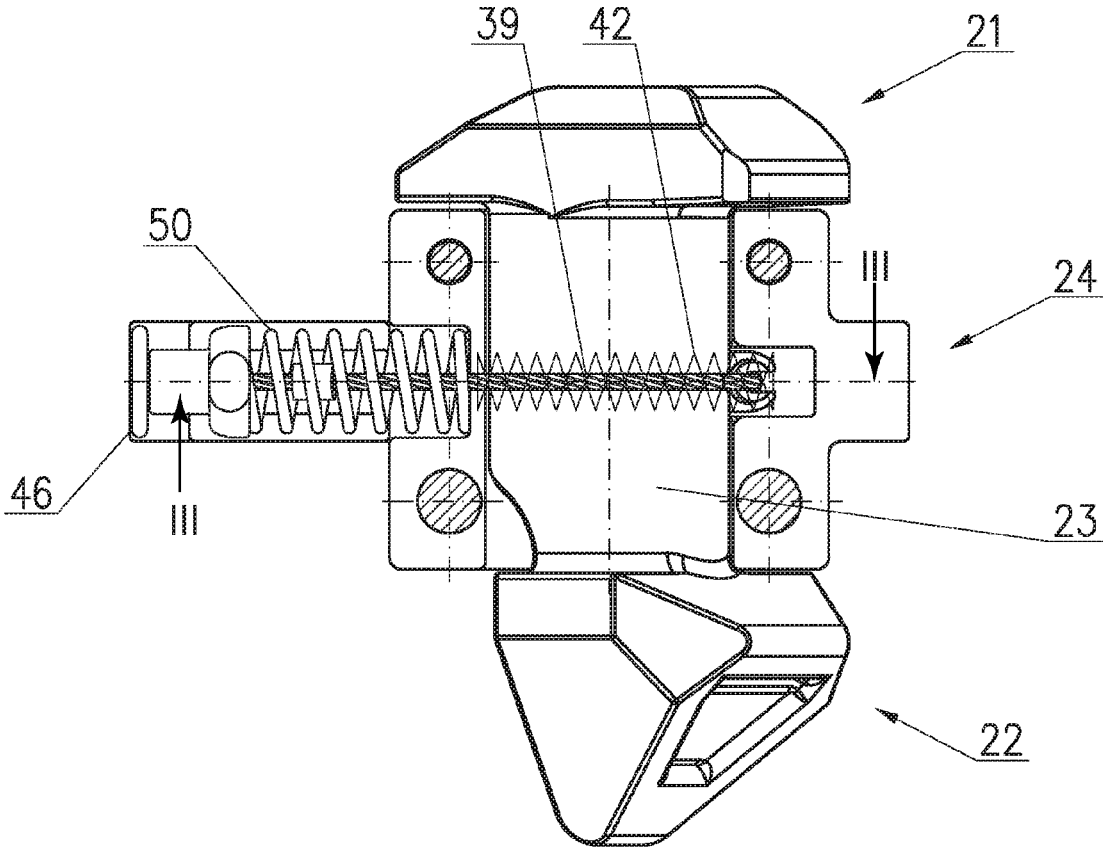
FIG. 13 is a side view in the semiautomatic position of a coupling member with inventive characteristics, according to one embodiment.
Figure 14:
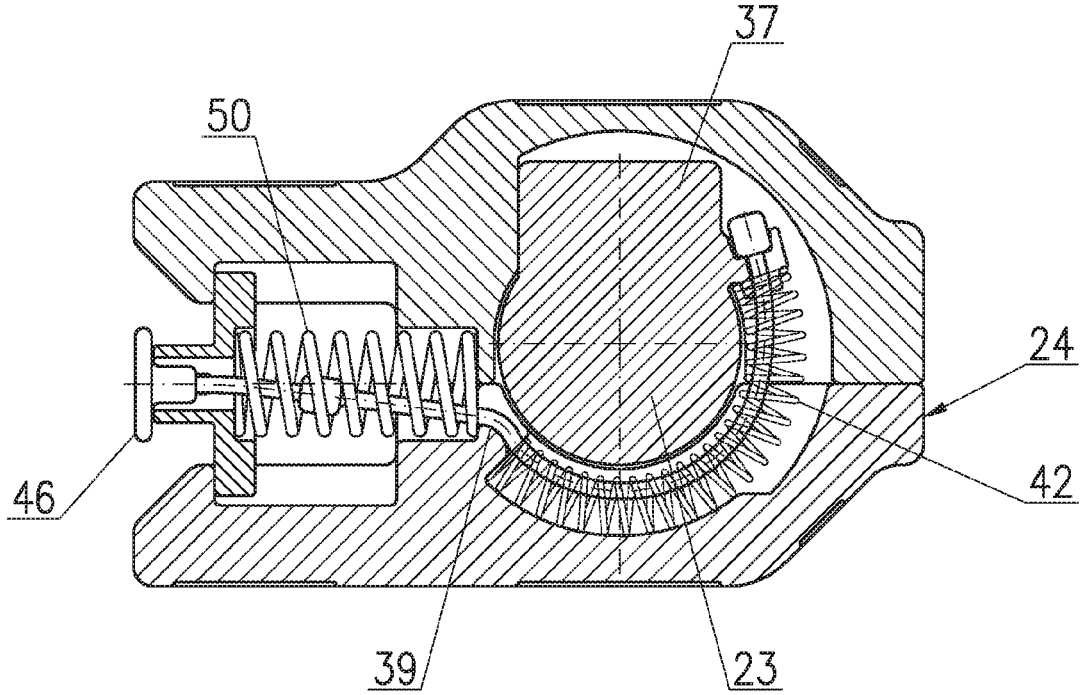
FIG. 14 is a cross section in Plane of a coupling member according to FIG. 13.
Figure 15:
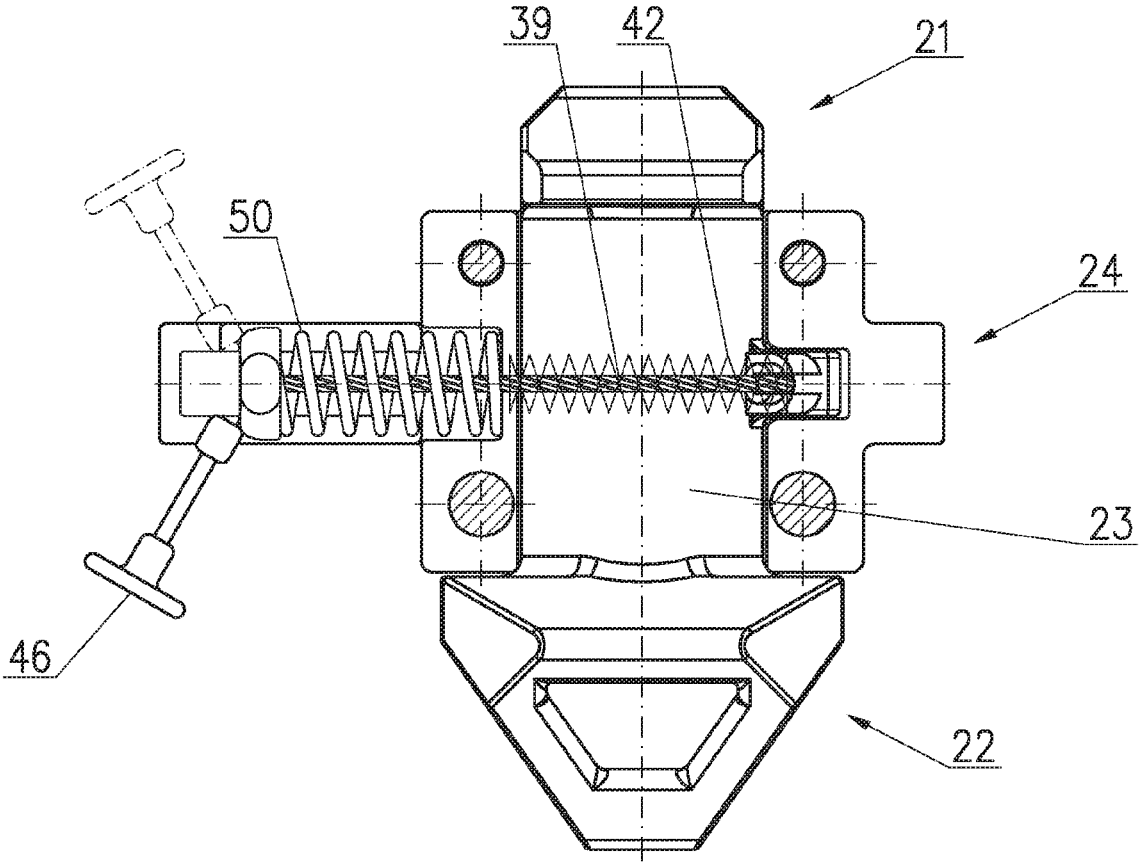
FIG. 15 is a side view in the automatic position of a coupling member according to FIG. 13.
Figure 16:
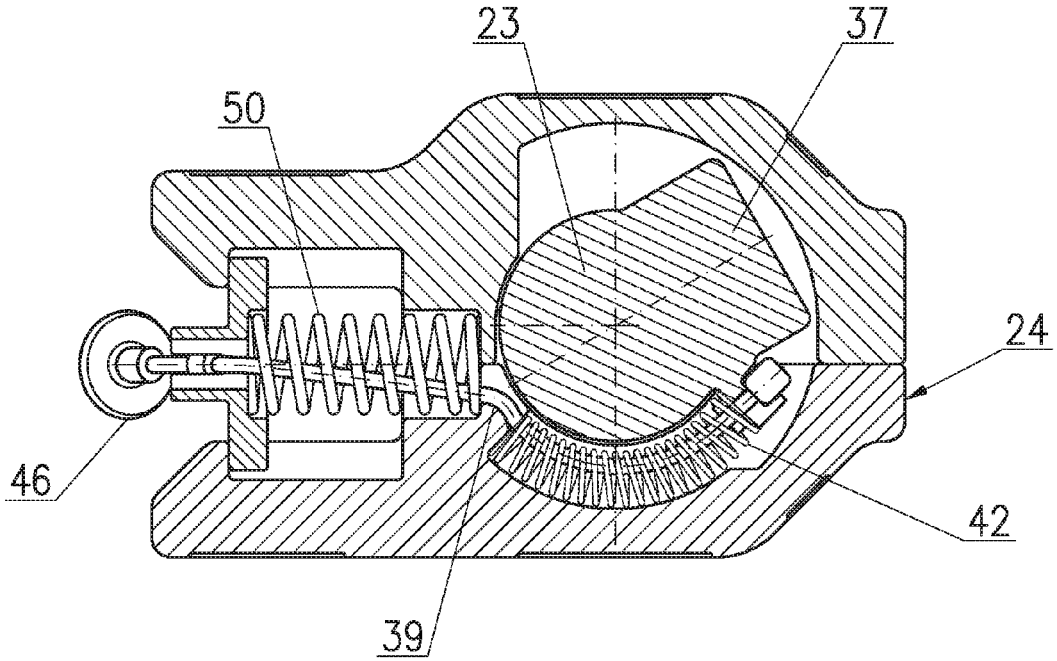
FIG. 16 is a cross section similar to FIG. 14 of a coupling member according to FIG. 15.
Figure 17:
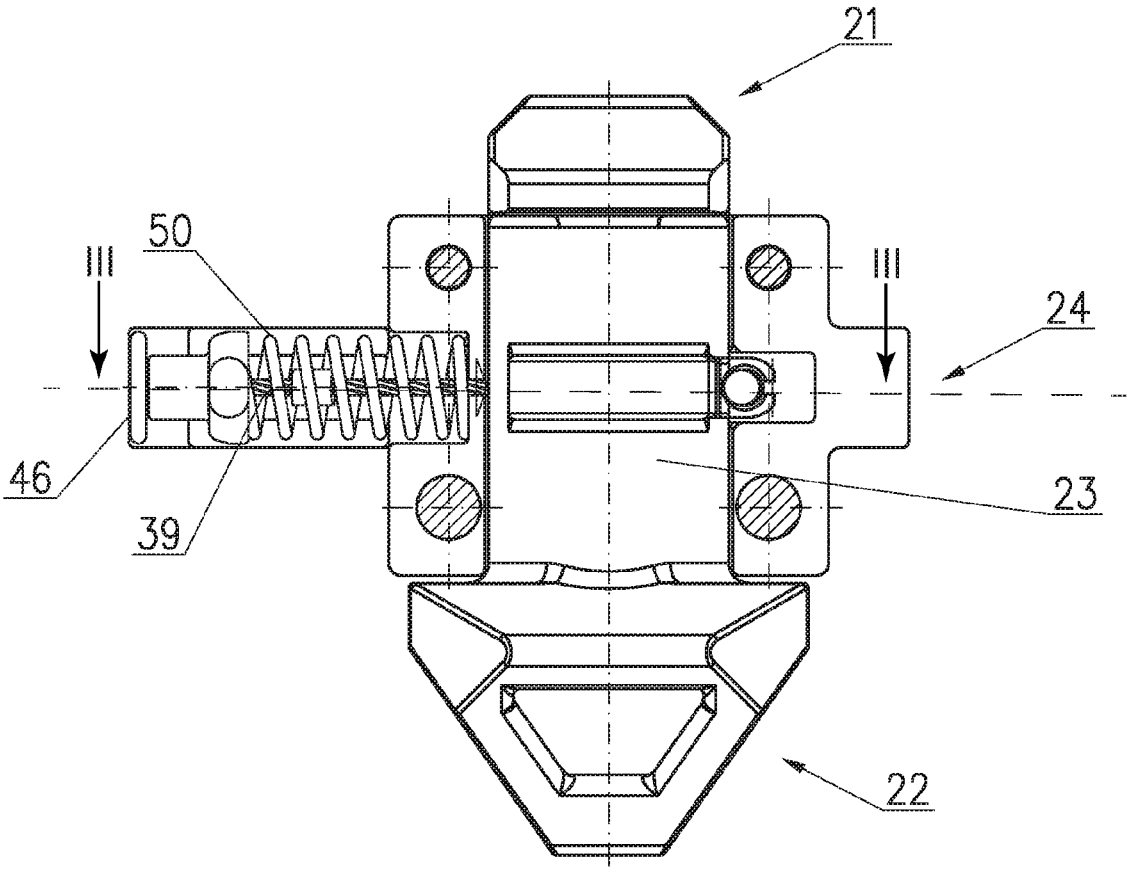
FIG. 17 is a side view in the semiautomatic position of a coupling member with inventive characteristics, according to one embodiment.
Figure 18:
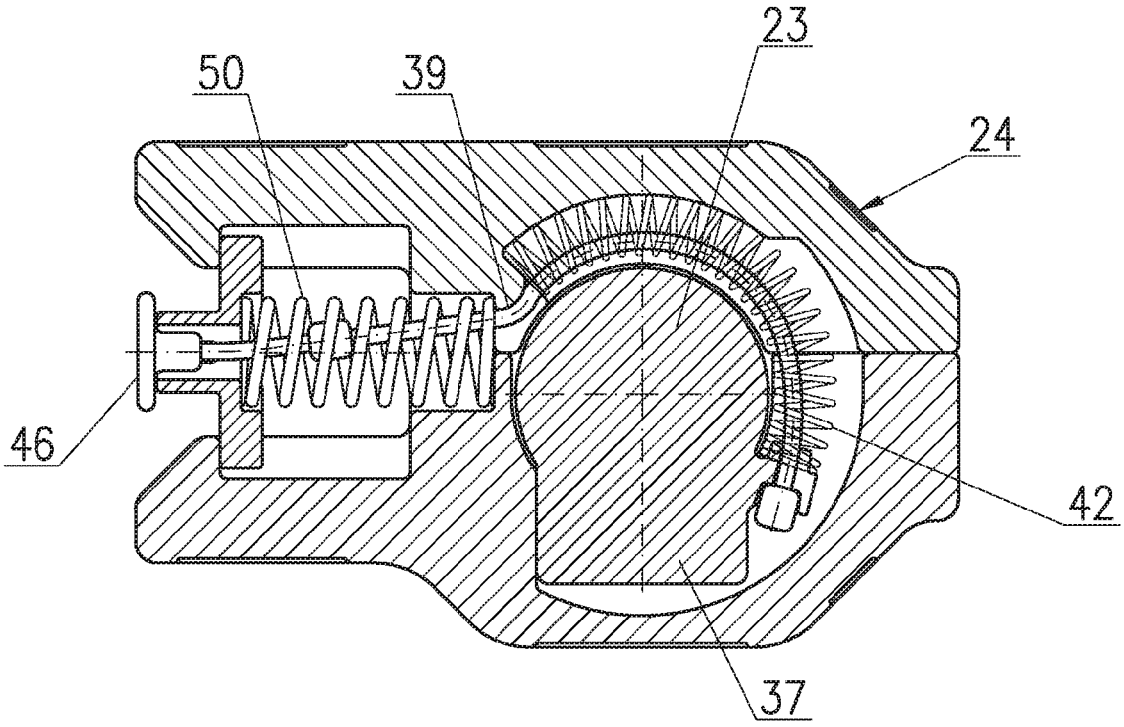
FIG. 18 is a cross section in Plane of a coupling member according FIG. 17.
Figure 19:
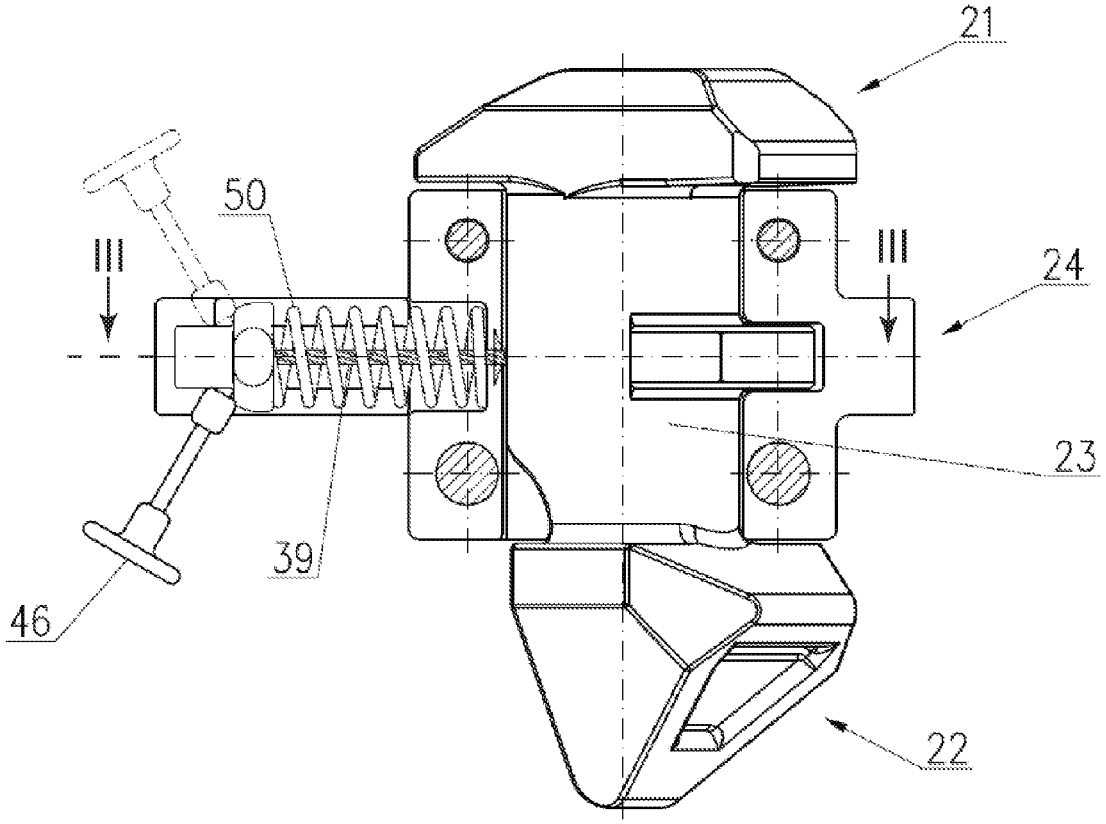
FIG. 19 is a side view in the automatic position of a coupling member according to FIG. 17.
Figure 20:
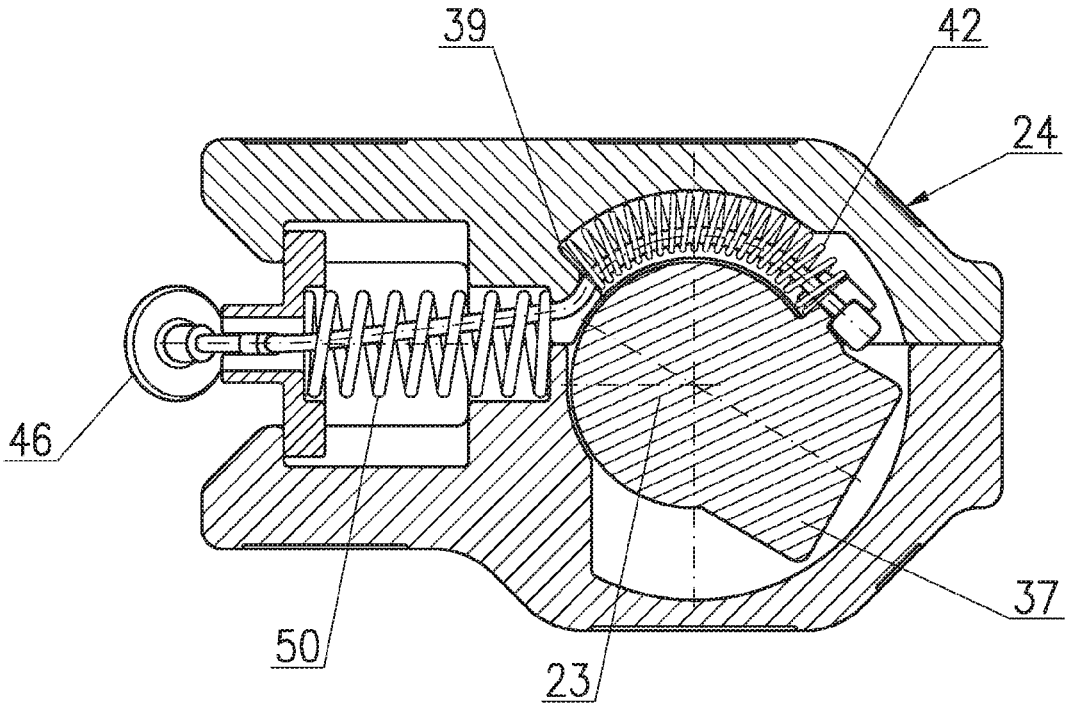
FIG. 20 is a cross section similar to FIG. 18 of a coupling member according to FIG. 19.

In this case the stop plate 28 is constructed as a pronounced flange which with stacked containers 33, 34 rests between the corner fittings 32, 35 and holds these at a distance (see FIG. 12). Coupling members are also known, however, in which the stop plate 28 is only constructed as a flaring which engages in bevels on the long holes 31, 36 of the corner fittings 32, 35 such that the corner fittings 32, 35 rest directly upon each other. The actual function of the stop plate 28 is to ensure that the coupling member does not slide into the lower corner fitting 32 of the upper container 33, in the event the crane operator should happen to set the coupling member next to the long hole 31.

The shaft 23 features a radially protruding stop pin 37. The stop pin 37 is positioned approximately in the plane of the stop plate 28 in which a recess 38 is also positioned in the housing 24. Inside the recess 38 the stop pin 37 and thus the entire shaft 23 with the coupling projections 21, 22 can twist around the long axis of the shaft 23 within a certain angular range. In addition, a Bowden cable 39 eccentrically engages on the shaft 23. To that end the Bowden cable could touch directly on the stop pin 37. In this case, however, a separate receptacle 40 is provided for the Bowden cable. A thickening 41 engages behind the receptacle 40 at one end of the Bowden cable 39 in a known manner.

A part of the Bowden cable 39, namely the section facing the thickening 41 itself, is positioned in a pressure spring 42. The pressure spring 42 is supported on one side on the receptacle 40 and on the other side on an end area 43. The Bowden cable 39 is then guided further outward through a bore hole 45 in the area of the end area 43. At the end of the Bowden cable 39 opposite the thickening 41 a handle 46 is positioned on the Bowden cable 39. At this end the Bowden cable 39 is guided through a locking means, namely a locking carriage 47. The locking carriage 47 is positioned to displace in another recess 48. For that reason the recess 48 features two guides 49 opposite each other (see FIG. 3). An additional pressure spring 50 is positioned inside the recess 48 which again surrounds the Bowden cable 39 and is supported on the one side on the locking carriage 47 and on the other side inside a blind hole 51 on the housing 24.

The Bowden cable 39 is also constructed with an additional thickening, namely a locking thickening 52 which in this case is positioned inside the recess 48. The locking thickening 52 is firmly connected to the Bowden cable 39. It is separated from the hand grip 46 by a predetermined distance which is determined by what angle the shaft 23 should turn inside the housing 24 when the Bowden cable 39 is activated. The Bowden cable 39 with its handle 46 and its thickenings 41 and 52 thus forms an activation element for the coupling member 20.

Figure 2:
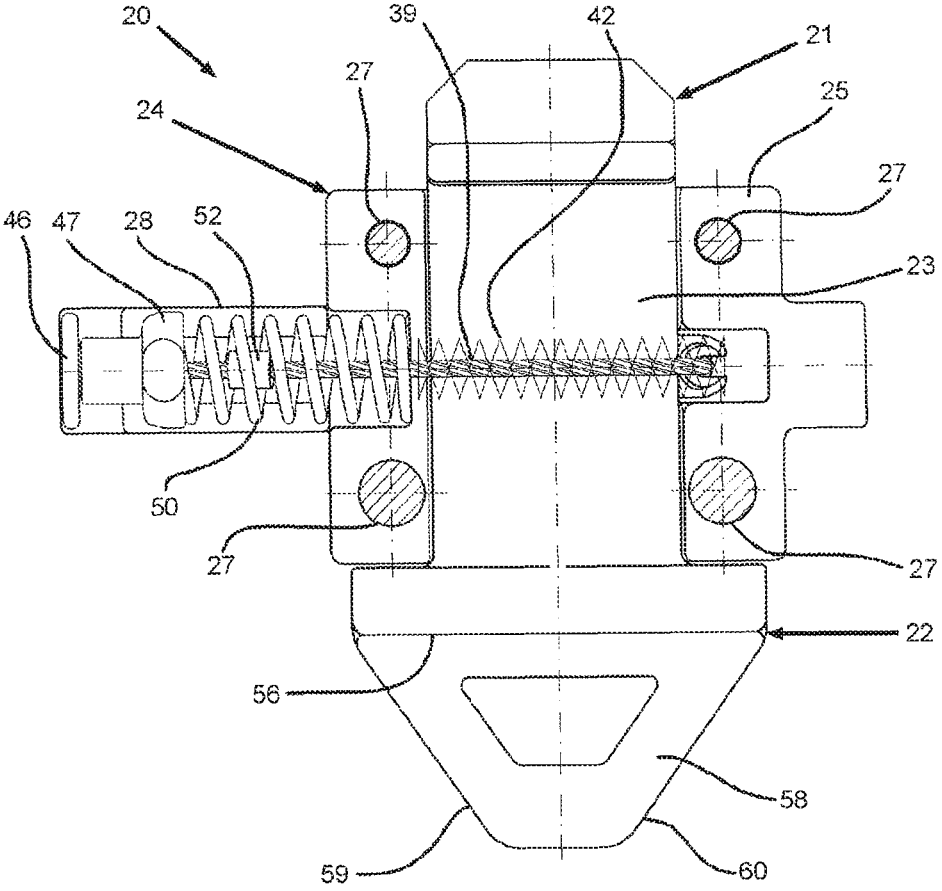
FIG. 2 is a side view of a coupling member according to FIG. 1, partially cut in the Plane II-II.
Figure 3:
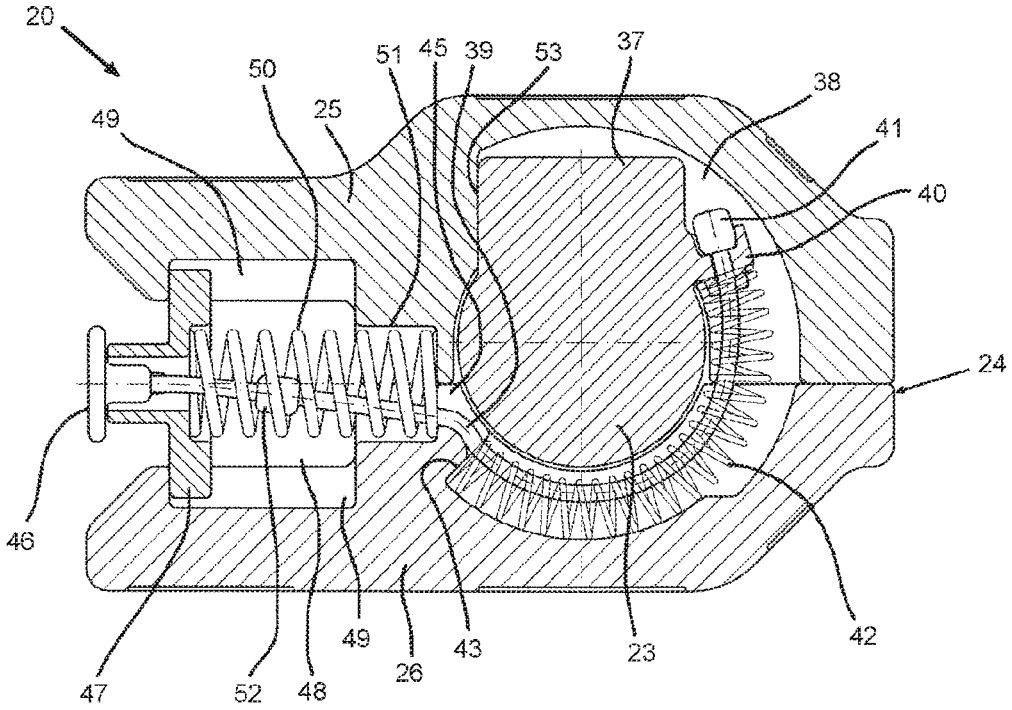
FIG. 3 is a cross-section in Plane of a coupling member according to FIG. 1.

The coupling member described above functions in the following manner: In FIGS. 1 to 3 the coupling member 20 is shown in its automatic position. This position also simultaneously forms the basic position of the coupling member 20 in which it has a released locking means. Because of the tension of the spring 42 the stop pin 37 impacts against a stop 53 (FIG. 3) which simultaneously limits the recess 38. The pressure spring 42 namely pre-tensions the coupling member in the direction of its automatic position. In the depiction according to FIG. 3 the pressure spring 50 presses the locking carriage 47 entirely to the left into its position farthest from the blind hole 51. In this automatic position the coupling member 20 operates as a fully automatic coupling member, as described in DE 102 38 895 A1, which is hereby incorporated by reference. A detailed description of its manner of operation can therefore be omitted at this point.

Figure 4:
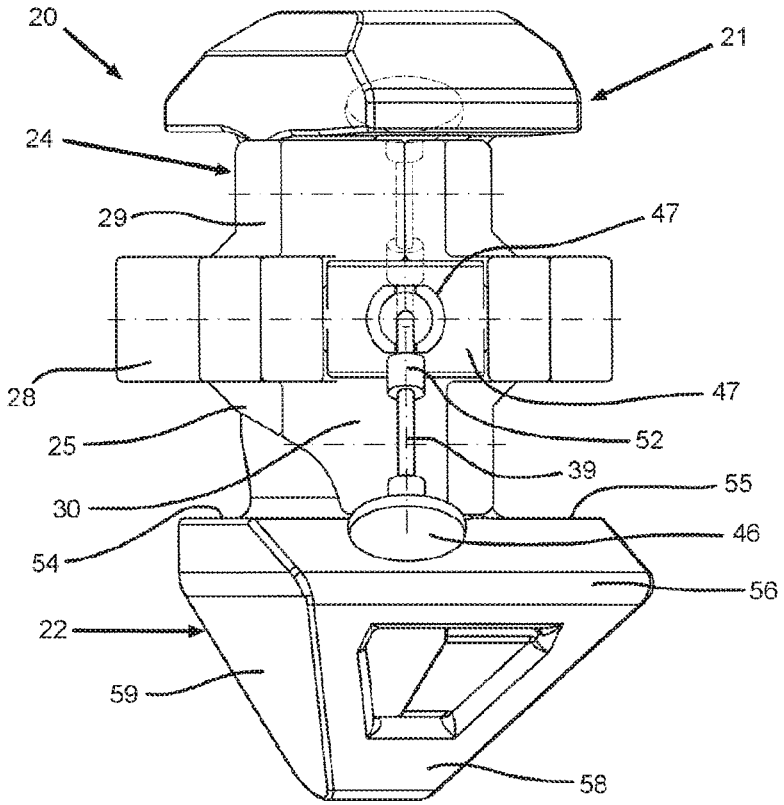
FIG. 4 is a front view in semiautomatic position of the coupling member according to FIG. 1.
Figure 5:
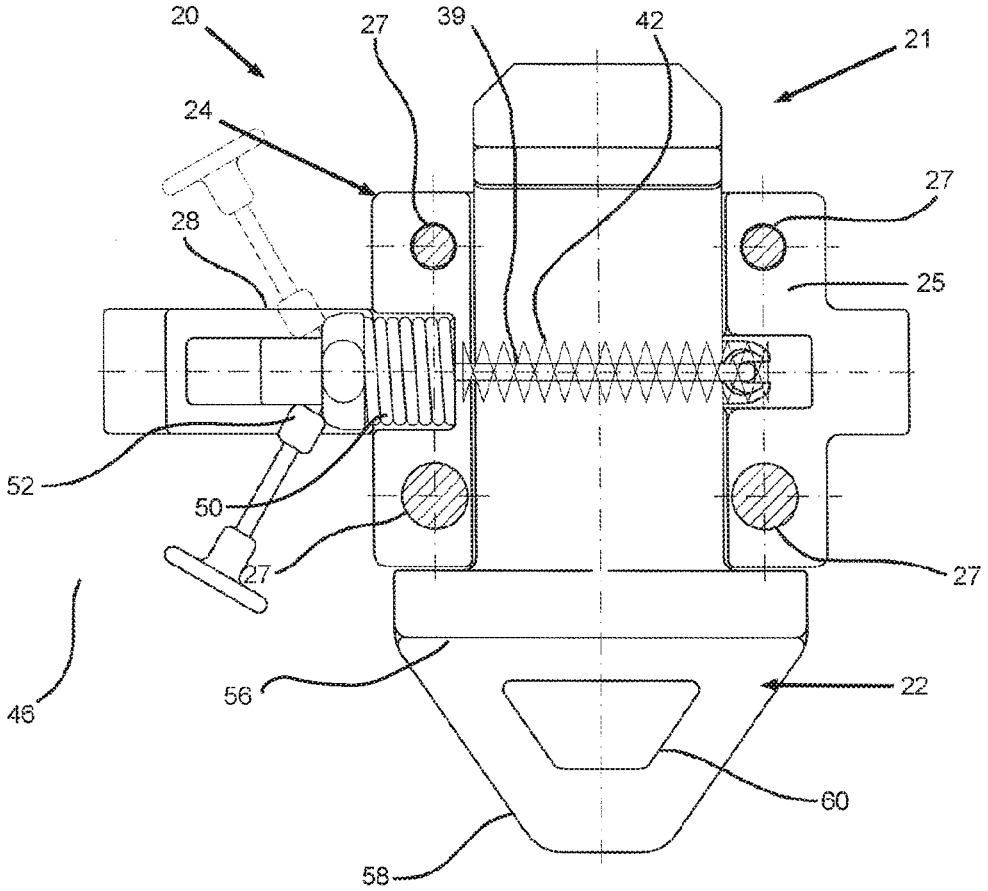
FIG. 5 is a side view of a coupling member according to FIG. 4, partially cut similar to FIG. 2.
Figure 6:
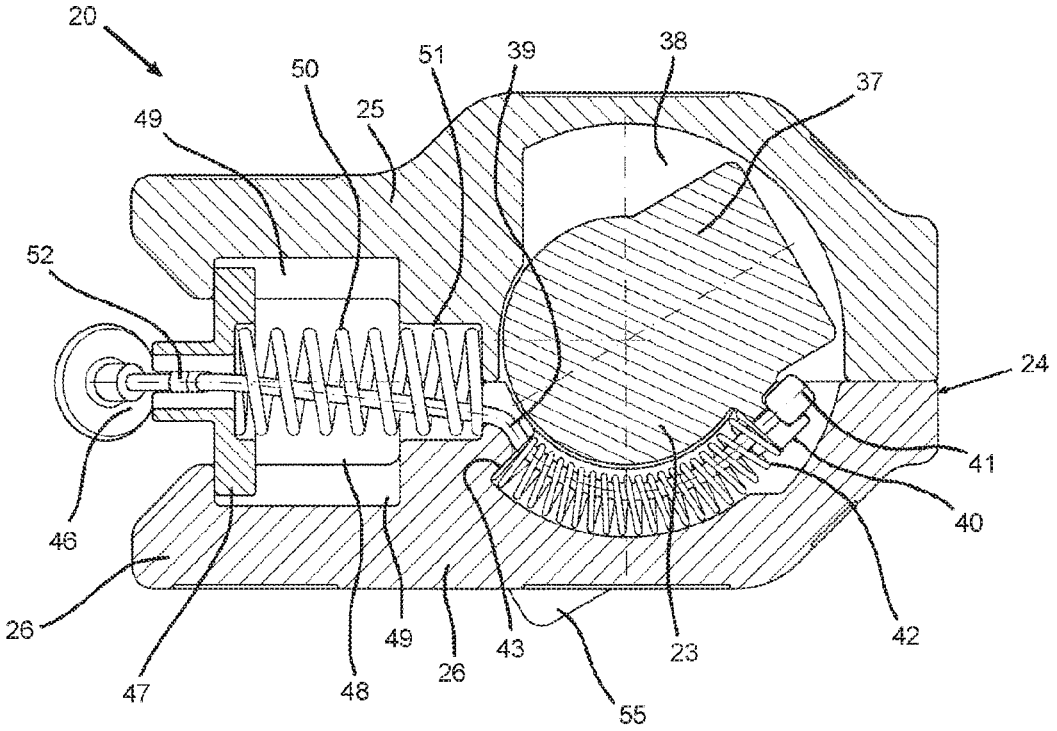
FIG. 6 is a cross-section similar to FIG. 3 of a coupling member according to FIG. 4.

By pulling the handle 46 the coupling member 20 is switched into its semiautomatic position shown in FIGS. 4 to 6. By means of the handle 46 the Bowden cable 39 is thus pulled out so far that the lock thickening 52 is released behind the locking carriage 47. Consequently, the shaft 23 turns and with it the coupling projections 21 and 22 by a predetermined angle, in this case 60°, clockwise in the depiction according to FIG. 6 and the pressure spring 42 is tensioned. The operator next pulls the handle 46 downward depicted with an unbroken line in FIG. 5, or alternatively upward as in the depiction with dashed lines. By releasing the handle 46 the locking thickening 52 engages with the locking carriage 47 as shown in FIG. 5.

Since the pressure spring 50 is stronger than the pressure spring 42, the locking carriage 47 remains in its position fully to the left shown in FIG. 6. As can be easily seen in FIG. 4, the lower coupling projection 22 protrudes left and right in the depiction of FIG. 4 (shoulders 54 and 55).

Figure 10:
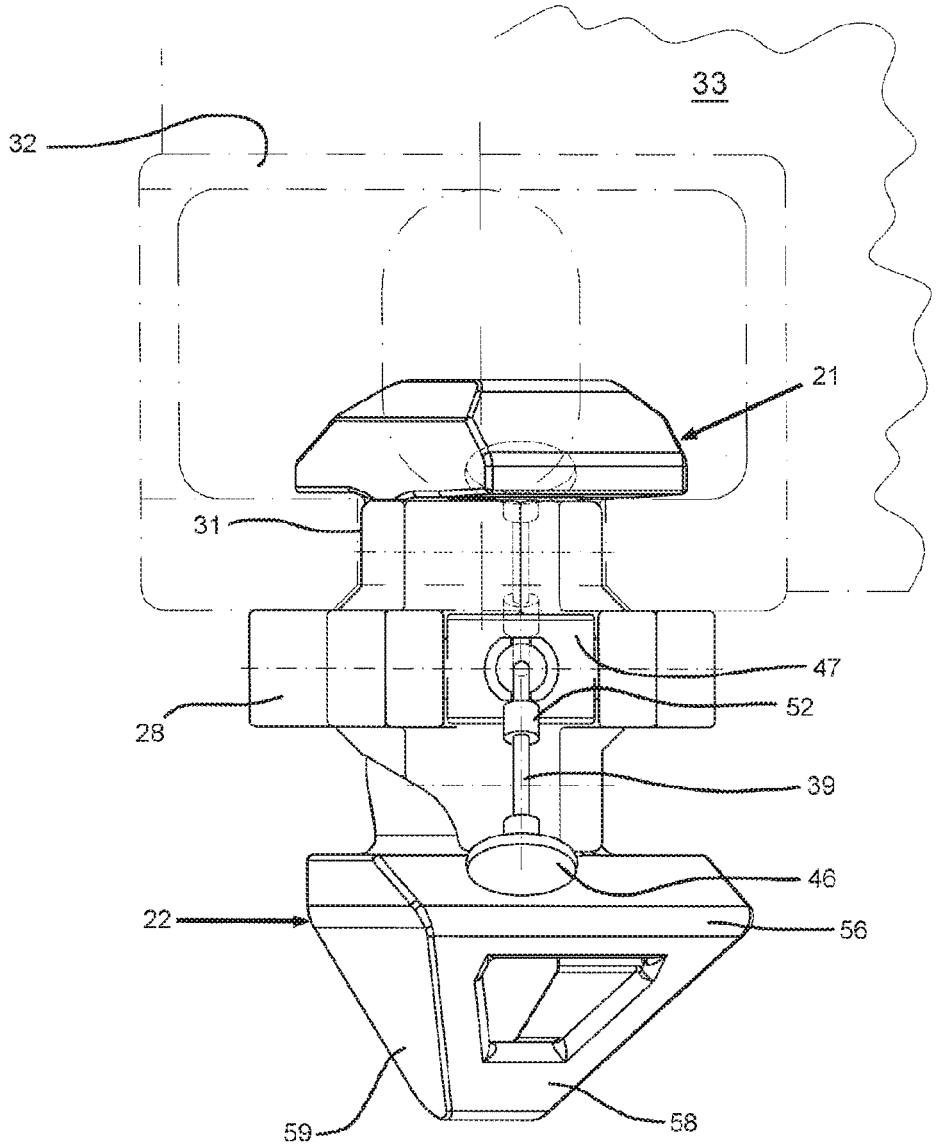
FIG. 10 is a front view of a coupling member according to FIG. 4 hung in a lower corner fitting of an upper container.

When stowing containers, the coupling member 20 is first inserted into the lower corner fitting 32 of an upper container 33. To that end the stowage personnel initially turn the upper coupling projection 21 by about 90° such that the upper coupling projection 21 approximately corresponds with the upper appendage 29 so that the upper coupling projection 21 can be guided through the long hole 31 into the corner fitting 32. The stowage personnel can thus so turn the upper coupling projection 21 such that it either pulls on the handle 46 or engages the lower coupling projection 22 and turns it. The upper coupling projection 21 turns into the position shown in FIGS. 1 to 3 upon release because of the spring force of the pressure spring 42. The coupling member 20 is now locked in the corner fitting 32 (FIG. 10). After the coupling member 20 is inserted in this manner into each of the four corner fittings 32 of the upper container 33, the crane operator hoists the upper container 33 on the ship and places it on a lower container 34. The crane operator thereby brings the lower coupling projection 22 in congruence with the long hole 36 at the upper corner fittings 35 of the lower container 34 and threads the lower coupling projection 22 into the associated long hole 36.

Figure 7:
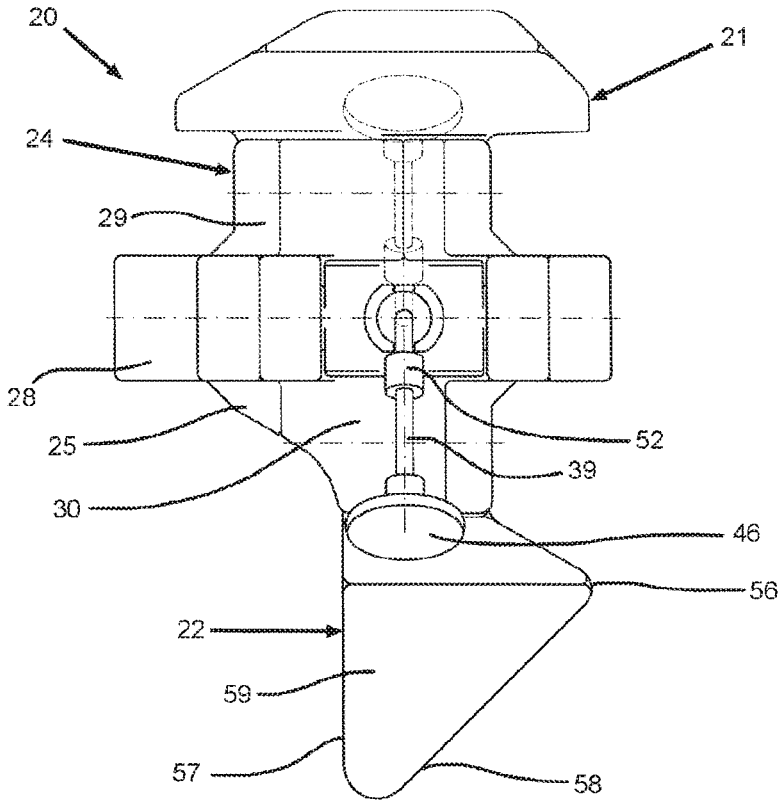
FIG. 7 is a front view in semiautomatic position of the coupling member according to FIG. 1.
Figure 8:
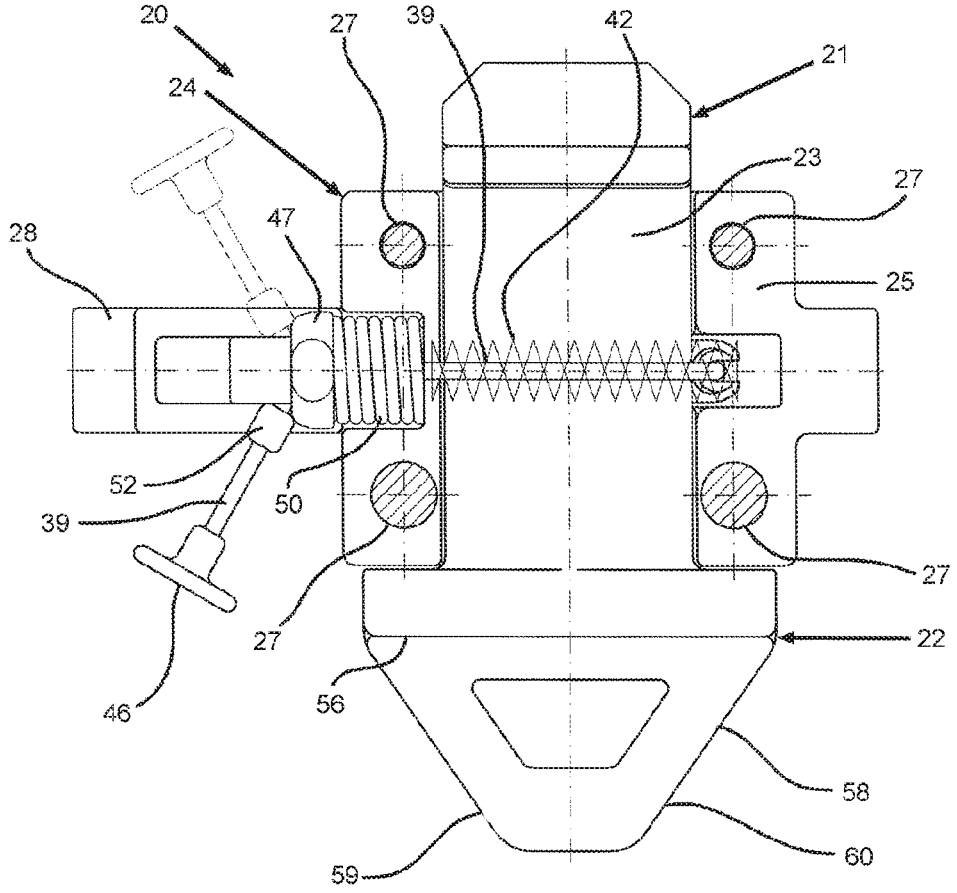
FIG. 8 is a side view of a coupling member according to FIG. 7, partially cut similar to FIG. 2.
Figure 9:
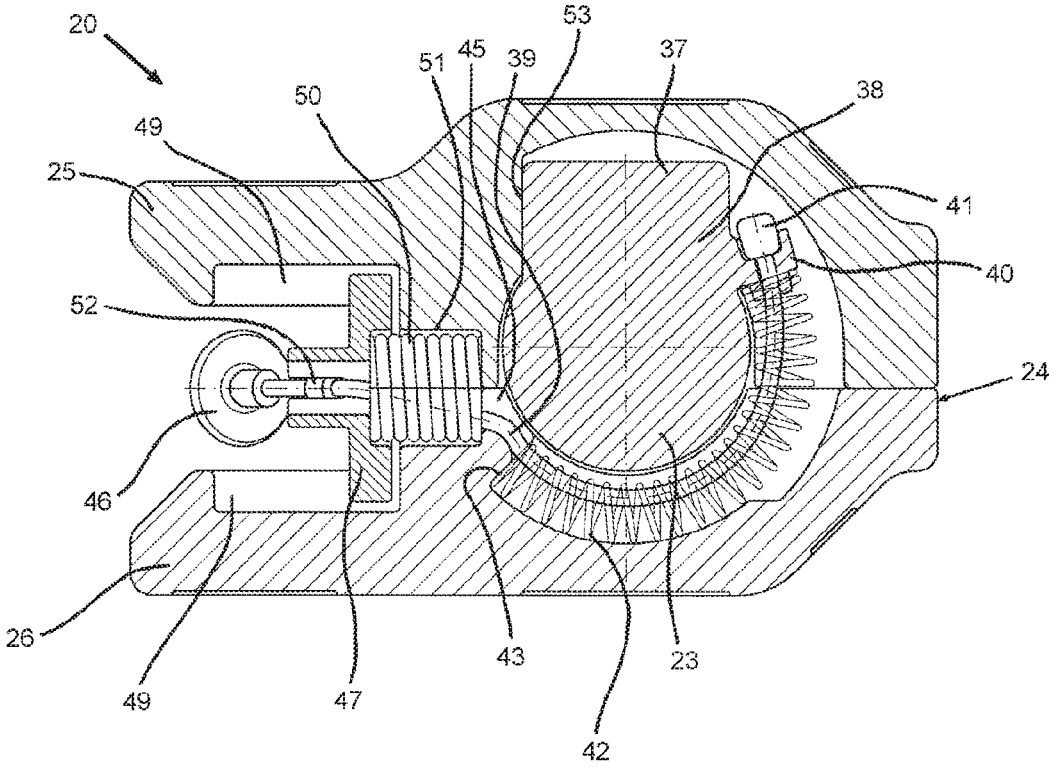
FIG. 9 is a cross-section similar to FIG. 3 of a coupling member according to FIG. 7.
Figure 11:
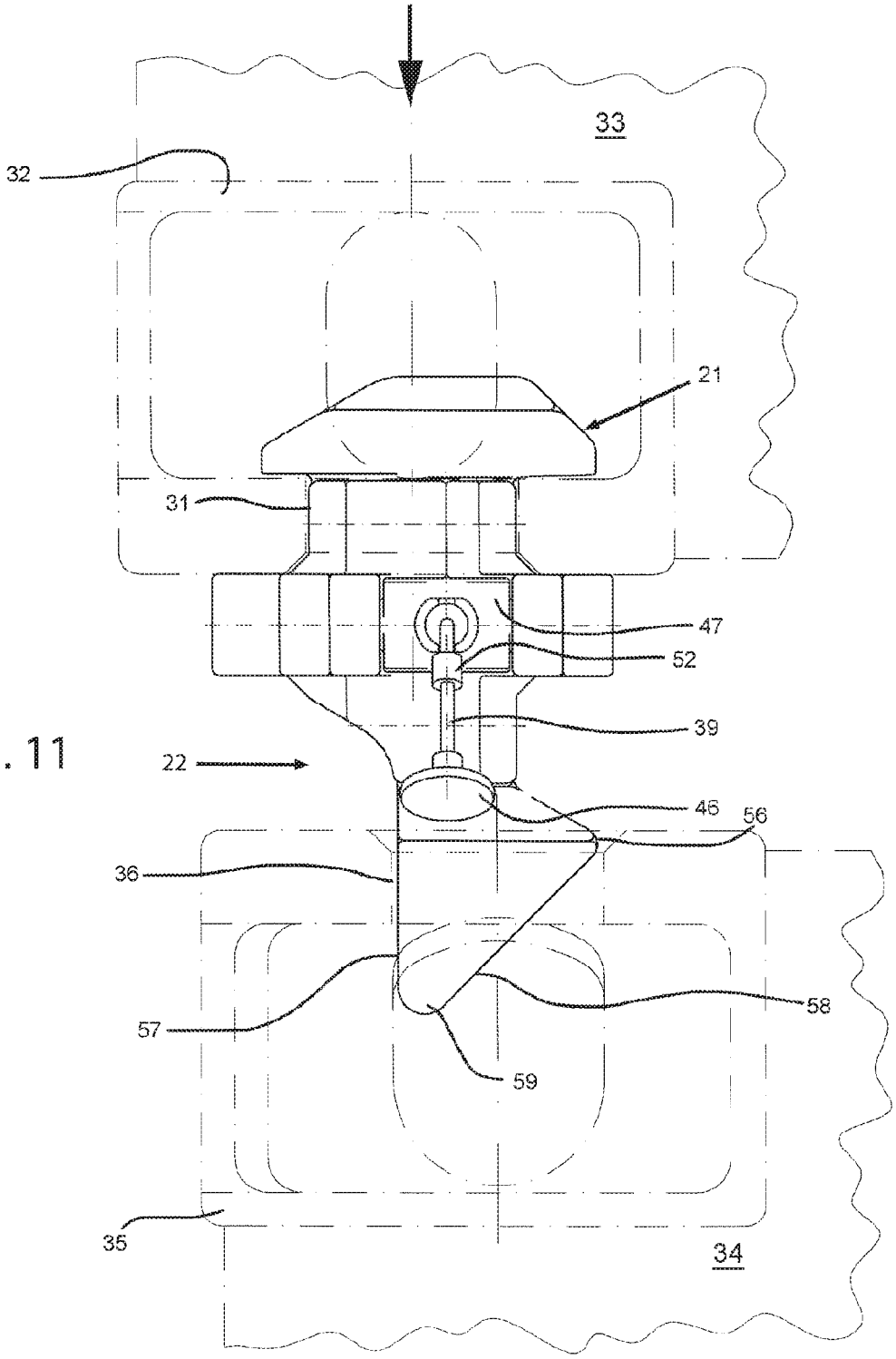
FIG. 11 is a coupling member according to FIG. 7 with a second coupling protrusion partially located in an upper long hole.

By further lowering of the container 33 the lower coupling projections 22 are introduced into the long holes 36. Because of their special contour the lower coupling projections 22 thereby turn back in the direction of the automatic position, as shown in FIG. 11. This position is also shown in FIGS. 7 to 9. As can be easily recognized in FIG. 9, the pressure spring 42 thereby releases tension, while the pressure spring 50 is tensioned. In the process the locking carriage 47 is also displaced fully to the right up to the blind hole 51. The pressure spring 50 tensions the locking carriage 47 and thus also the coupling member 20 in the direction of the semiautomatic position.

By an additional lowering of the upper container 33 the lower coupling projection 22 is lowered deeper into the corner fitting 35 until it finally is released below the long hole 36. Because of the tensioning of the spring 50 the lower coupling projection 22 is again turned back into the semiautomatic position (FIG. 12). In the process the pressure spring 42 is again tensioned. As can be easily recognized in FIG. 12, the long hole 36 engages in the shoulders 34 and 35 on both sides so that an automatic unlocking is no longer possible as it was in the automatic position.

Since the upper coupling projection 21 always turns together with the lower coupling projection 22, care must be taken in the design of the upper coupling projection 21 that in each position between the semiautomatic position and the automatic position, the long hole 31 always securely engages behind at the lower corner fitting 32 of the upper container 33. As can be recognized in FIGS. 1, 4, 7 and 11, the upper coupling projection 21 with the shaft 23 forms the shape of a T. As a result of the fact that the coupling projections 21, 22 with the shaft 23 are turned by about 60° from the automatic position to the semiautomatic position, it must always be ensured that the upper coupling projection 21 engages behind the long hole 31 on the lower corner fitting 32 of the upper container 33. Any other measure, however, which ensures this outcome is suitable and resides within the context of this invention.

As an alternative to the embodiment shown in which the upper coupling projection 21 is firmly connected to the shaft 23 and thus always rotates together with the shaft 23 and the lower coupling projection 22, the upper coupling projection can also be independent of the shaft, for example, it can be attached permanently on the housing or rotate independently.

To unlock the coupling member 20 the stowage personnel pull on the handle 46 and release the locking thickness 52 from the locking carriage 47. Because of the pre-tensioning of the pressure spring 42 the lower coupling projection 21 now turns back again into the automatic position and the coupling member 20 can unlock, like the known fully automatic coupling member according to DE 102 38 895 A1, when the upper container 33 is raised by a crane.

In order that during the threading into the long hole 36 of the upper corner fitting 35 the lower coupling projection 22 turns out of the semiautomatic position in the direction of the automatic position, the coupling projection 22, as indicated above, is designed with a special contour. The coupling member 20 features on the lower coupling projection 22 a sideward protruding locking lug 56. On the (back) side opposite the locking lug 56 the lower coupling projection is provided with an approximately vertical rear wall 57. In addition, the lower coupling projection 22 runs below the locking lug 56 like an inverted pyramid. Underneath the locking lug 56 the lower coupling projection 22 is also provided with a downward running slope 58 opposite the rear wall 57. The two side edges 59 and 60 are positioned at an incline to each other. This contour has the result that the lower coupling projection 22 and naturally with it the shaft 23 and the upper coupling projection 21 turn during the threading into the long hole 36 of the upper corner fitting 35 of the lower container 34 solely because of the lowering of the upper container 33 on the lower container 34.

In the embodiment shown the actuating organs (Bowden cable 39, etc.) as well as the locking carriage 48 and the pressure springs 42 and 50 are positioned in the stop plate 28. The separation between the corner fittings 32 and 35 because of the stop plate 28 simultaneously ensures that the stowage personnel can grasp the handle 46. With coupling members having a stop plate 28 which is not designed as a pronounced flaring but instead a simple flaring engaging in the bevels of the long holes 31, 36, then as stated above the corner fittings 32, 35 rest directly on each other. In this case the actuating organ is so positioned that the stowage personnel can grasp it through one of the openings which are provided in the side walls of the corner fittings. Preferably the opening is hereby selected which is positioned on the front of the container, since the opening located in the other side wall is not accessible, if several containers are stacked closely next to each other.

The coupling member 20 was previously so described that the pressure spring 42 pre-tensions the lower coupling projection 22 and thus the coupling member 20 in the automatic position. The automatic position also forms the basic position. It is however also alternatively conceivable that the semiautomatic position is also the basic position and the pressure spring 42 pre-tensions the coupling member in the semiautomatic position. The coupling member is then switched into the automatic position by the actuating organ and is locked in this position in the above described manner. That can occur as a result of the fact that the lower coupling projection is positioned to turn around the shaft rotation angle of the coupling member provided for switching with respect to the orientation to the upper coupling projection shown in the drawing opposite the rotation direction for switching, in the case depicted also in the overhead view (viewed from the upper to the lower coupling projection) counterclockwise, as depicted in FIGS. 13-16, or the Bowden cable 39 is laid differently around the shaft 39 and the stop for the stop pin is displaced correspondingly to the other side of the stop pin, as depicted in FIGS. 17-20.

It is clear to specialists that the invention is not limited to the embodiment depicted and the concretely described modifications but instead that multiple modifications are possible without departing from the invention. For example, instead of pressure springs 42 and 50 other elastic elements can be used and they do not have to surround the Bowden cable 39.

LIST OF REFERENCE CHARACTERS

20 Coupling member
21 Coupling projection
22 Coupling projection
23 Shaft
24 Housing
25 Housing shell
26 Housing shell
27 Screw
28 Stop plate
29 Appendage
30 Appendage
31 Long hole
32 Corner fitting
33 Container
34 Container
35 Corner fitting
36 Long hole
37 Stop pin
38 Recess
39 Bowden cable
40 Receptacle
41 Thickening
42 Pressure spring
43 End area
45 Bore hole
46 Handle
47 Locking carriage
48 Recess
49 Guide
50 Pressure spring
51 Blind hole
52 Locking thickness
53 Stop
54 Shoulder
55 Shoulder
56 Locking lug
57 Rear wall
58 Incline
59, 60 Side walls

The invention claimed is:

1. A coupling member for joining together a first container and a second container, stacked above each other comprising:

a first coupling projection which is mounted in a corner fitting of the first container and locked there;

a second coupling projection that is coupled with a corner fitting of the second container;

an actuating organ by means of which the second coupling projection is switched between an automatic position in which the first container and the second container lock and unlock fully automatically during loading and unloading, and a second position in which the first container and the second container must be unlocked manually by an operator during unloading;

a first spring pre-tensioning the second coupling projection in the automatic position and is switched by the actuating organ into the second position against the pre-tensioning force of the first spring;

a locking means for locking the second coupling projection in the second position by locking the actuating organ;

a second spring pre-tensioning the second coupling projection in a direction toward the second position if the actuating organ is locked;

wherein the second position of the second coupling projection is a semiautomatic position in which the first container and the second container lock fully automatically during loading.

2. The coupling member according to claim 1, wherein the actuating organ is locked on the locking means in the semiautomatic position and the actuating organ is mounted so as to move and is pre-tensioned in the direction toward the semiautomatic position of the second coupling projection.

3. The coupling member according to claim 2, wherein the locking means is mounted in a displaceable manner.

4. The coupling member according to claim 1, wherein the second coupling projection is mounted so as to rotate on a housing and is rotatable between the automatic position and the semiautomatic position.

5. The coupling member according to claim 4, wherein the locking means is mounted on the housing.

6. The coupling member according to claim 1, wherein the second spring is stronger than the first spring.

7. The coupling member according to claim 1, wherein the first coupling projection and the second coupling projection are connected to each other with a common shaft.

8. The coupling member according to claim 7, wherein the first coupling projection and the second coupling projection and the common shaft are constructed as one-piece with each other.

9. A coupling member for joining together a first container and a second container stacked above each other, the coupling member comprising:

a first coupling projection that is mounted in a corner fitting of the first container and locked there;

a second coupling projection that is coupled with a corner fitting of the second container;

an actuating organ by means of which the second coupling projection is switched between an automatic position in which the first container and the second container lock and unlock fully automatically during loading and unloading, and a second position in which the first container and the second container must be unlocked manually by an operator during unloading;

a first spring pre-tensioning the second coupling projection in the second position and is switched by the actuating organ into the automatic position against the pre-tensioning force of the first spring;

a locking means locking the second coupling projection in the automatic position by locking the actuating organ; and a second spring pre-tensioning the second coupling projection in a direction toward the automatic position if the actuating organ is locked;

wherein the second position of the second coupling projection is a semiautomatic position in which the first container and the second container lock fully automatically during loading.

10. The coupling member according to claim 9, wherein the actuating organ is locked on the locking means in the automatic position and the actuating organ is mounted so as to move and is pre-tensioned in the direction toward the automatic position of the second coupling projection.

11. The coupling member according to claim 10, wherein the locking means is mounted in a displaceable manner.

12. The coupling member according to claim 9, wherein the second coupling projection is mounted so as to rotate on a housing and is rotatable between the automatic position and the semiautomatic position.

13. The coupling member according to claim 12, wherein the locking means is mounted on the housing.

14. The coupling member according to claim 9, wherein the second spring is stronger than the first spring.

15. The coupling member according to claim 9, wherein the first coupling projection and the second coupling projection are connected to each other with a common shaft.

16. The coupling member according to claim 15, wherein the first coupling projection and the second coupling projection and the common shaft are constructed as one-piece with each other.

* * * * *